US006669820B2

(12) United States Patent
Odell

(10) Patent No.: US 6,669,820 B2
(45) Date of Patent: Dec. 30, 2003

(54) TWIN-WIRE FORMER

(75) Inventor: Michael Odell, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 12 days.

(21) Appl. No.: 10/054,349

(22) Filed: Jan. 18, 2002

(65) Prior Publication Data

US 2002/0096301 A1 Jul. 25, 2002

(30) Foreign Application Priority Data

Jan. 22, 2001 (FI) ..... 20010129

(51) Int. Cl.[7] ..... D21F 1/00

(52) U.S. Cl. ..... 162/300; 162/301; 162/352; 162/351; 162/348; 162/203

(58) Field of Search ..... 162/300, 301, 162/352, 351, 203, 348

(56) References Cited

U.S. PATENT DOCUMENTS

| | | | | |
|---|---|---|---|---|
| 3,066,068 A | * | 11/1962 | Calehuff et al. | 162/208 |
| 3,810,818 A | * | 5/1974 | Arledter | 162/301 |
| 5,019,214 A | | 5/1991 | Meinecke et al. | |
| 5,141,600 A | | 8/1992 | Meinecke et al. | |
| 5,389,206 A | * | 2/1995 | Buck et al. | 162/300 |
| 5,798,024 A | | 8/1998 | Odell et al. | |

FOREIGN PATENT DOCUMENTS

| | | | | |
|---|---|---|---|---|
| FI | 783/72 | | 8/1977 | |
| FI | 903553 | | 7/1990 | |
| FI | 91173 | | 2/1994 | |
| GB | 1378055 | | 12/1974 | |
| WO | 95/19467 | * | 7/1995 | 162/301 |

* cited by examiner

*Primary Examiner*—Steven P. Griffin
*Assistant Examiner*—Mark Halpern
(74) *Attorney, Agent, or Firm*—Stiennon & Stiennon

(57) ABSTRACT

A twin-wire former in a paper machine has two forming wire loops (10, 20), which define between themselves a twin-wire zone. At least one dewatering box (30) is located inside one of the wire loops (10, 20) to remove water through the wire from a web (W) being formed. At least one loading blade (40) is located opposite the dewatering box (30) inside the other wire loop (20; 10) in contact with the other wire. The dewatering box (30) includes at least three successive dewatering zones (**30*a*, 30*b*) in which every second zone (30*a*) has a vacuum (p) and every second zone (30*b*) is vacuum-free. The at least one loading blade (40) is placed inside one of the wire loops (20; 10) at a location where it is opposed by a respective vacuum-free zone (30*b*), which is preceded and followed by a vacuum zone (30*a***).

21 Claims, 4 Drawing Sheets

TWIN-WIRE FORMER

CROSS REFERENCES TO RELATED APPLICATIONS

This application claims priority on Finnish Patent Application No. 20010129, Filed Jan. 22, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a twin-wire former in a paper machine, which former includes two forming wire loops defining between themselves a twin-wire zone, and at least one dewatering box located inside one of the wire loops to remove water through said wire from the web being formed, and at least one loading blade located opposite to the dewatering box inside the other wire loop and in contact with said wire, said dewatering box including at least three successive dewatering zones.

In a gap former of a paper machine, a pulp suspension is fed into a forming gap between two forming wires, which wires are guided to curve over a forming roll and/or a forming shoe, which is equipped with a curved blade deck. In the narrowing gap, water is removed from the pulp suspension, among other things, by the action of a pressure caused by the tension of the wires, on the one hand, through the outer wire boosted by the centrifugal force and, on the other hand, through the inner wire boosted by the suction acting in the forming roll or shoe.

In the twin-wire zone after the forming gap, various kinds of web forming and dewatering elements are used, the purpose of which is to bring about pressure pulsation in the fiber layer being formed in order to promote dewatering of the web being formed and to improve its formation at the same time. U.S. Pat. No. 5,798,024 describes a state-of-the-art gap former in which a forming shoe and a loading blade unit function as dewatering and web forming elements after a forming roll. The blade deck of the forming shoe may be straight or curved. The loading blade unit includes a dewatering box provided with dewatering blades and a set of blade elements the loading of which can be controlled and which are placed inside opposite wire loops and in alternating positions with respect to one another so that the pressure pulses applied to the web by the dewatering blades and the loading blades alternate in the running direction of the web. The dewatering achieved by the loading blade unit is boosted by arranging a vacuum at at least one blade set and, preferably, at both blade sets.

The formation of the paper produced is improved by using a loading blade unit but, at the same time, it increases the porosity of paper, sometimes even to a harmful degree. Especially when making fine paper, high porosity may be a property which is attempted to be avoided. For this reason, loading blade units are not generally used when making paper grades containing highly beaten pulp and an abundance of filler. It has been found that in such cases it is preferable to use, for example, a forming shoe as the dewatering element, because it brings about lower pressure pulses in the fiber layer and affects the porosity of paper considerably less than a loading blade unit.

An aim of the invention is to reduce the above-noted problems associated with the prior art. A particular aim is to provide a novel twin-wire former by means of which efficient dewatering is achieved even at high running speeds and which makes it possible to produce paper having uniform formation and suitable porosity.

SUMMARY OF THE INVENTION

The twin-wire former according to the invention includes one or more dewatering boxes by means of which vacuum zones and vacuum-free zones are arranged in the web forming and dewatering zone, which zones alternate in the running direction of the web. One or more loading blades are arranged inside the wire loop situated opposite to the dewatering box, the loading blades being disposed such that opposite to each loading blade on the opposite side of the web there is a vacuum-free zone, which is preceded and followed by a vacuum zone. Since the vacuum zones and the loading blades are arranged to alternate in the running direction of the web in the proposed manner, the vacuum boosting dewatering and the loading blade producing a pressure pulse will never simultaneously affect the web that is being formed.

Alternation of the vacuum zones and vacuum-free zones is provided, for example, by dividing one continuous dewatering box with partitions into compartments which form several successive dewatering zones. Of these zones, every second zone is connected to a vacuum source in order to make dewatering more effective, and from every second zone water is removed mechanically without any significant vacuum.

Different vacuums can be advantageously arranged in the different vacuum zones so that the vacuum may be increased in the running direction of the web as the solids content of the web increases and dewatering becomes more difficult.

The number of loading blades and vacuum zones may vary in different applications. What is essential is that opposite to the loading blade there is always a vacuum-free zone, which is preceded and followed by a vacuum zone. In addition to this, the twin-wire former may include a preloading blade which precedes the dewatering box proper and which is also most advantageously placed at a location where it is opposed by a zone working without vacuum.

The invention combines characteristic features of known dewatering elements in a totally new way, so that by means of the new twin-wire former it is possible to simultaneously achieve good formation produced by the loading blades and moderate paper porosity produced by the suction forming shoe.

In the following, the invention will be described in greater detail with reference to the figures shown in the appended drawings, but the invention is not meant to be exclusively limited to the details of the figures.

DESCRIPTION OF THE PREFERRED EMBODIMENTS

Figure 1:
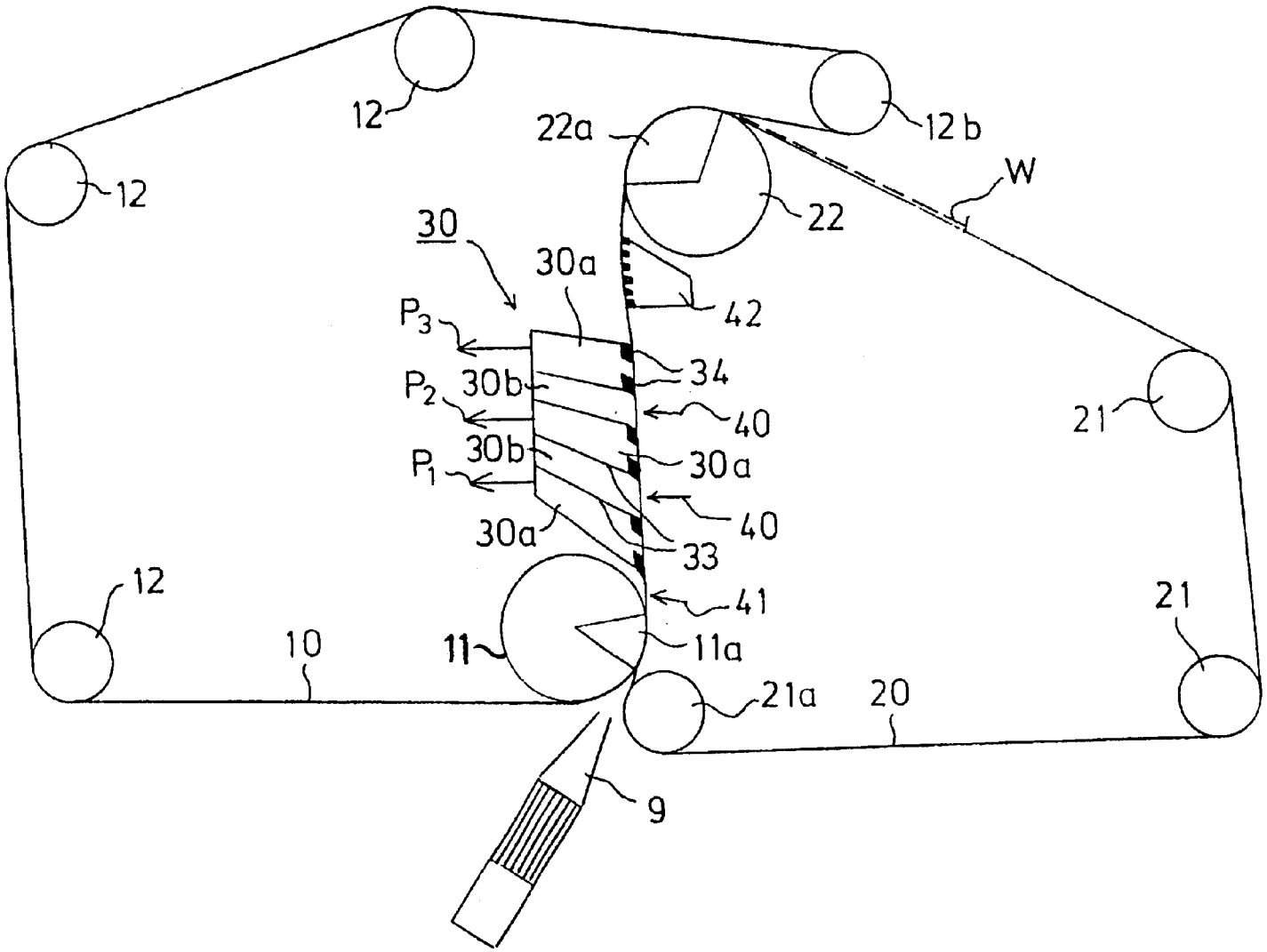
FIG. 1 shows a roll gap former in which vacuum zones and vacuum-free zones alternate, and at the latter zones the web is loaded with the aid of loading blades.

The twin-wire former shown in FIG. 1 includes a first forming wire loop 10, the running of which is guided by a first forming roll 11 and by guide rolls 12, 12*b*, and a second forming wire loop 20, the running of which is guided by guide rolls 21, 21*a* and by a second forming roll 22. A pulp suspension is fed from a headbox 9 into a forming gap, which is defined by the first forming roll 11 on the side of the first wire 10 and by a breast roll 21*a* on the side of the second wire 20. The joint run of the wires 10 and 20 extends substantially in the vertical direction from a suction sector 11*a* of the first forming roll 11 all the way to a suction sector 22*a* of the second forming roll 22, after which the first wire 10 is guided by a guide roll 12*b* to separate from a web W, which will run with the second wire 20.

In the twin-wire zone, that is, in the joint run of the wires 10, 20, there is, in addition to the above-mentioned forming rolls 11, 22, also a set of dewatering elements, of which a dewatering box 30 is located inside the first wire loop 10 immediately after the first forming roll 11, and a suction box 42 is located inside the second wire loop 20 immediately before the second forming roll 22. In addition, in the area of the dewatering zone there are a pre-loading blade 41, which is located inside the second wire loop 20 opposite to the area remaining between the forming roll 11 and the dewatering box 30, and loadable blade elements 40, which are located inside the second wire loop 20 opposite to the dewatering box 30.

On the surface of the dewatering box 30 in contact with the wire 10 there are dewatering blades 34 extending in the cross direction across the web and controlling the running of the wire, and between which dewatering blades water is removed from the web W in the direction of the dewatering box 30. The internal space of the dewatering box 30 is divided by partitions 33 into five successive zones 30*a*, 30*b*, of which three are connected to a vacuum source while a substantially normal pressure prevails in two. The vacuum zones 30*a* and the vacuum-free zones 30*b* alternate in the running direction of the web in such a way that each vacuum-free zone 30*b* is preceded and followed by a vacuum zone 30*a*. When required, different vacuums $p_1$, $p_2$, $p_3$ can be arranged in the different vacuum zones 30*a*. The vacuums are preferably arranged to increase in the running direction of the web ($p_1<p_2<p_3$). Water drained through the wire 10 is also guided away through the vacuum-free zones 30*b*, which dewatering is boosted by the pressure pulses applied to the web by the dewatering blades 34 and the loading blades 40 alternately.

At the dewatering box 30 inside the second wire loop 20 there are two loadable blade elements 40 which extend in the cross direction across the web supporting and loading the wire 20 and doctoring water from its surface. The loading blades 40 also produce pressure pulses in the web W being formed, in consequence of which dewatering becomes more effective and the formation of the web is improved. The loading blades 40 are placed, in a manner known in itself, in alternating positions with the dewatering blades 34 of the deck of the dewatering box 30. In the arrangement according to the invention, the loading blades 40 are placed specifically in those spaces between the dewatering blades 34 in which there is a vacuum-free zone 30*b* on the side of the dewatering box 30. In that connection, the suction effect applied by the vacuum zones 30*a* on the web and the pressure pulse applied by the loading blades 40 to the web alternate in the running direction of the web and they never occur at the same time.

Figure 2:
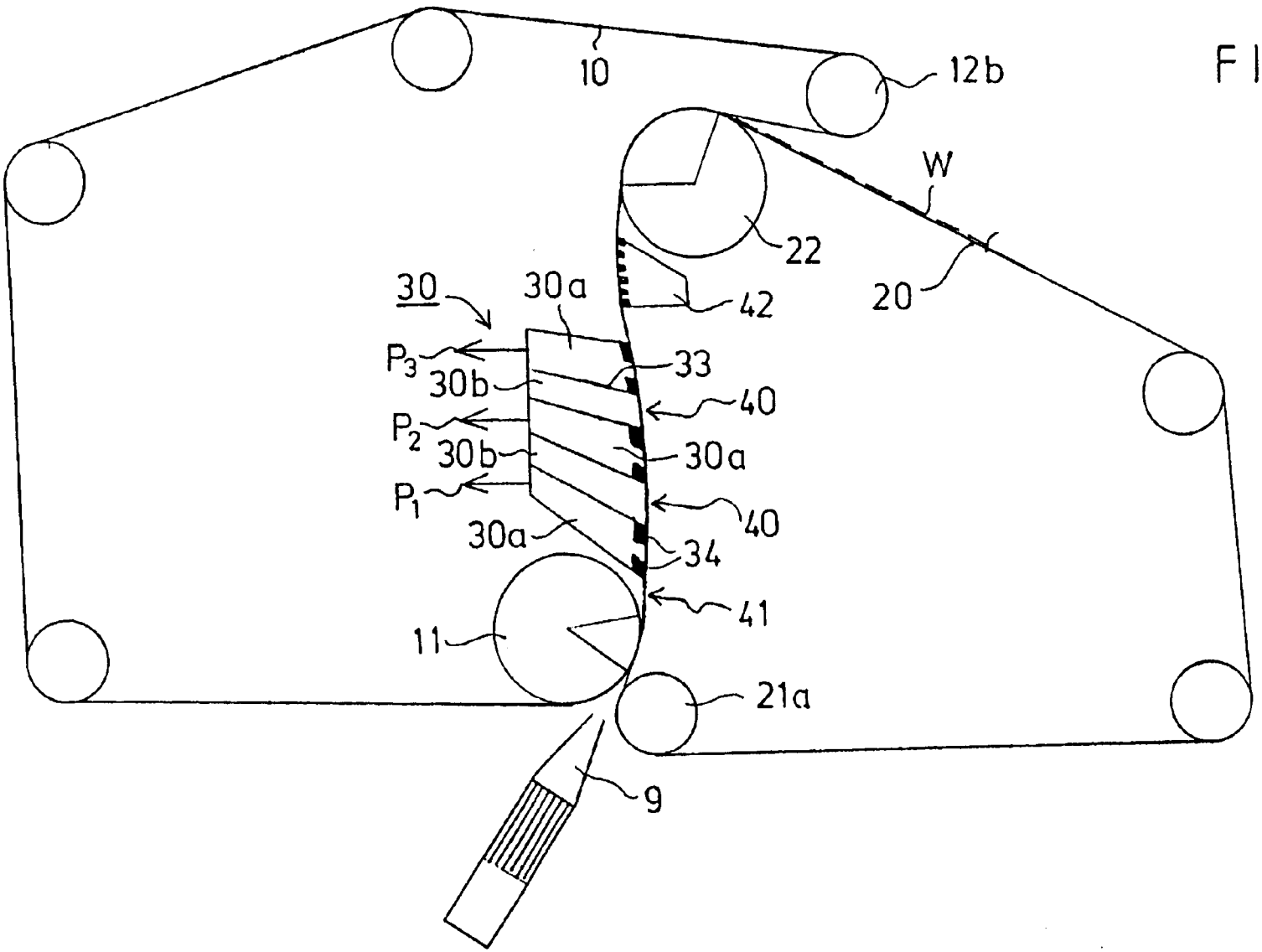
FIG. 2 shows an arrangement similar to that of FIG. 1, in which the surface of the dewatering box in contact with the wire is curved.

FIG. 2 shows a twin-wire former similar to the one shown in FIG. 1, in which the dewatering blades 34 are arranged to curve the wires 10, 20 while these travel over the dewatering box 30. This increases the pressure applied by the wires 10, 20 to the web and thus improves the efficiency of dewatering. The vacuum zones 30*a* and the vacuum-free zones 30*b* are arranged to alternate in the running direction of the web, and the loading blades 40 are located opposite to the vacuum-free zones 30*b*.

Figure 3:
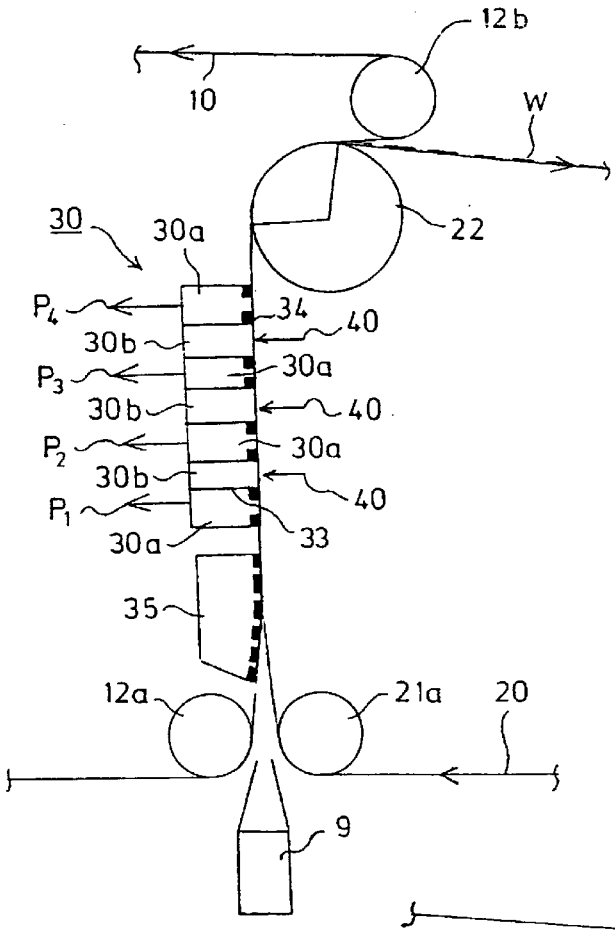
FIG. 3 shows a blade gap former.

FIG. 3 shows a blade gap former in which in the forming gap area the running of the wires 10, 20 is guided by two breast rolls 12*a* and 21*a* and by a suction forming shoe 35 having a curved surface. After the forming shoe 35, a dewatering box 30 is located inside the first wire loop 10, opposite to a set of loading blades 40 located inside the second wire loop 20. The dewatering box 30 is divided by partitions 33 into sections in such a way that a total of four vacuum zones 30*a* and three vacuum-free zones 30*b* is formed, which zones alternate in the running direction of the web W. Three loading blades 40 are located inside the second wire loop 20, each one opposite to a vacuum-free zone 30*b*.

Figure 4:
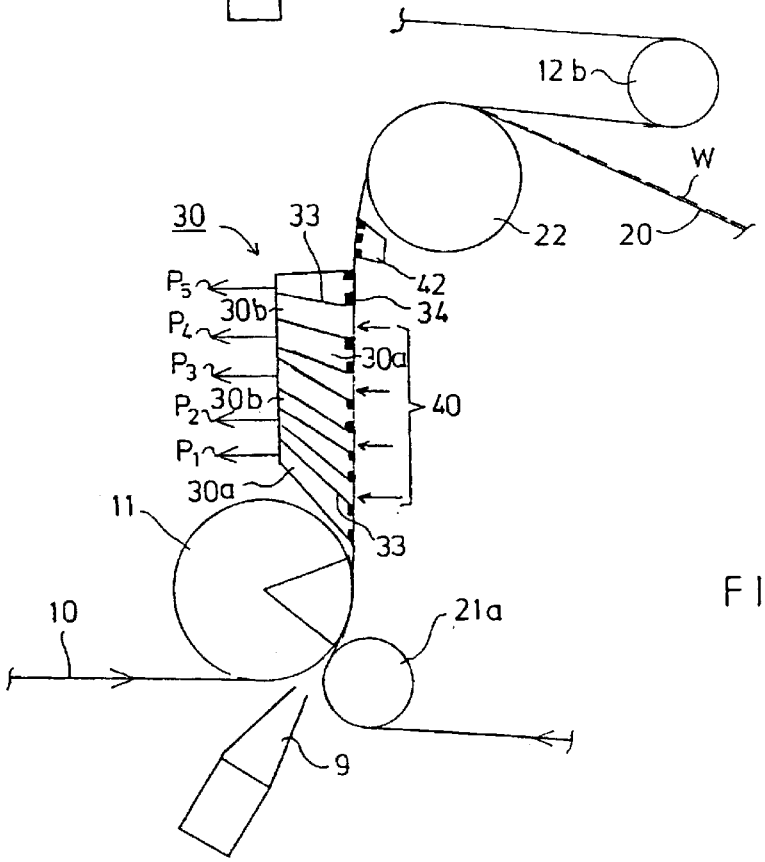
FIG. 4 shows a modification of the former shown in FIG. 1.

FIG. 4 shows a roll gap former whose dewatering box 30 includes five vacuum zones 30*a* and four vacuum-free zones 30*b*, four loading blades 40 being placed opposite to the vacuum-free zones inside the second wire loop 20.

Figure 5:
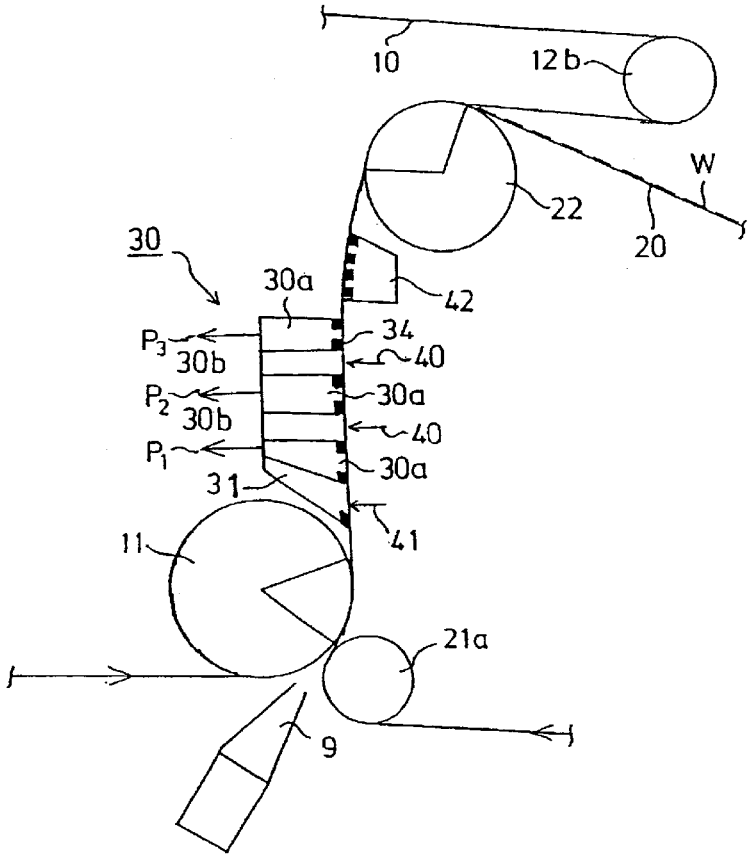
FIG. 5 shows another modification of the former shown in FIG. 1.

In the roll gap former shown in FIG. 5, the first zone 31 of a dewatering box 30 after a forming roll 11 is vacuum-free, and opposite to it there is a pre-loading blade 41 inside the second wire loop 20. After the first zone 31 there are three further vacuum zones 30*a* and two vacuum-free zones 30*b*, and opposite to the vacuum-free zones there are two loading blades 40 on the side of the second wire loop 20.

Figure 6:
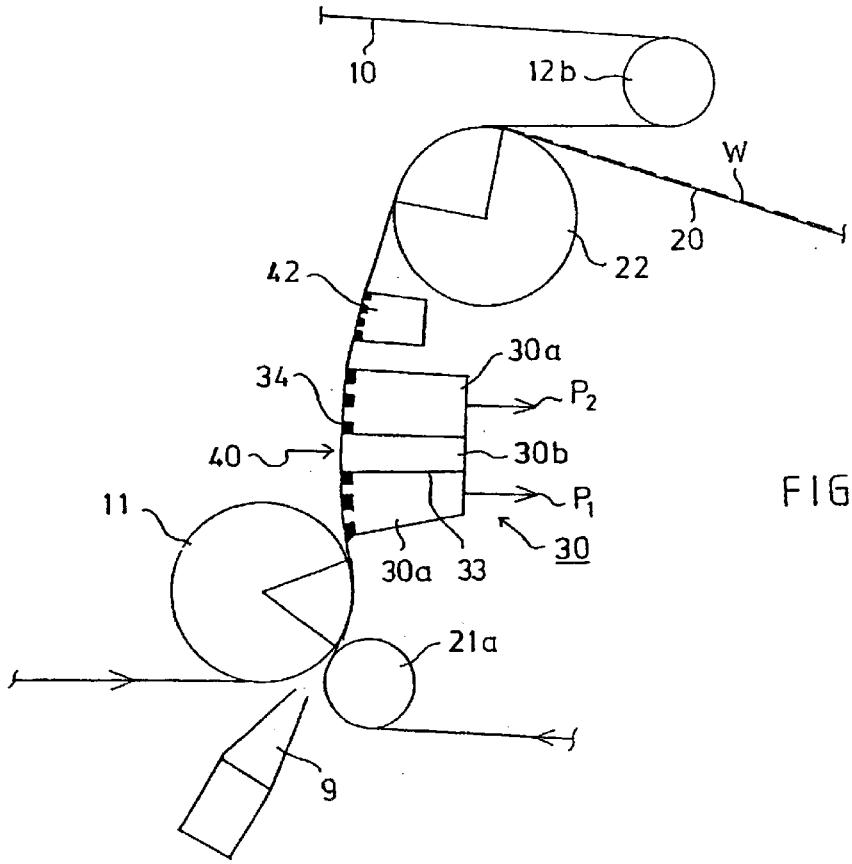
FIG. 6 shows an arrangement with a minimum number of loading blades and vacuum zones.

In the example shown in FIG. 6 there is only one loading blade 40 and it is located opposite to a vacuum-free zone 30*b* remaining between two vacuum zones 30*a*. The dewatering box 30 is followed further by a suction box 42 placed before the second forming roll 22. The loading blade 40 is located in the same wire loop 10 as the first forming roll 11, and the vacuum box 30 is located in the opposite wire loop 20 before the second forming roll 22.

Above, the invention has been described with reference to a few examples only. However, the invention is not intended to be limited to these examples only, but many other modifications of the invention are also possible with the scope defined by the appended claims.

I claim:

1. A twin-wire forma in a paper machine including two forming wire loops, which define between themselves twin-wire zone, and at least one dewatering box, which said at least one dewatering box is located inside one of the wire loops to remove water through said wire from a web being formed, and at least one loading blade, which is located opposite to the dewatering box inside the other wire loop in contact with the other wire, which dewatering box include at least three successive dewatering zones, wherein vacuum zones alternate with vacuum-free zones, and the loading blade or blades is/are placed inside one of the wire loops at a location where it or them is/are opposed by one of the vacuum-free zone(s), which is preceded and followed by one of the vacuum zone(s).

2. The twin-wire former of claim 1 wherein vacuums of different magnitude are arranged n at least two vacuum zones of the dewatering box.

3. The twin-wire former claim 2 wherein the magnitude of the vacuum of one of the least two vacuum zones of the dewatering box which is greater than the magnitude of another vacuum zone which precedes it in the running direction of the web.

4. The twin-wire former of claim 1 wherein on the surface of the dewatering box in contact with the wire there are dewatering blades which are disposed in such a way that the running of the wires over the dewatering box is along a linear path.

5. The twin-wire former of claim 1 wherein on the surface of the dewatering box in contact with the wire there are dewatering blades which are disposed in such a way that the running of the wires over the dewatering box is along a curved path.

6. The twin-wire former of claim 1 wherein in the running direction of the web before the dewatering box there is a pro-loading blade located inside the wire loop opposite to the dewatering box.

7. The twin-wire former of claim 1 wherein at the beginning of the dewatering box there is a vacuum-free zone which is opposed by a pro-loading blade located on the side of the second wire loop.

8. A twin-wire former in a paper machine, the former comprising:

a first forming wire loop;

a second fanning wire loop, wherein portions of the first forming wire loop and the second forming wire loop extend adjacent one another to define a twin-wire zone;

at least one dewatering box located inside the flint forming wire loop, to remove water through the first forming wire loop from a web being fanned, the at least one dewatering box having a first zone, a second zone downstream of the first zone, and a third zone downstream of the second zone, the first zone and the third zone having vacuum applied thereto, and the second zone having no vacuum applied thereto; and at least one loading blade, which is located opposite to the at least one dewatering box inside the second wire loop, the at least one loading blade being in contact with the second wire loop at a location opposed by the second zone, such that the at least one loading blade is positioned such that it is preceded and followed by zones of the at least one dewatering box having vacuum applied thereto.

9. The twin-wire former of claim 8 wherein the magnitude of the vacuum applied to the first zone is different thin the magnitude of the vacuum applied to the third zone.

10. The twin-wire former of claim 9 wherein the magnitude of the vacuum applied to the third zone is greater than the magnitude of the vacuum applied to the fist zone.

11. The twin-wire former of claim 8 further comprising a plurality of dewatering blades disposed on a surface of the at least one dewatering box in contact with the first wire loop such that the running of the first wire loop and the second wire loop over the dewatering box is along a linear path.

12. The twin-wire former of claim 8 further comprising a plurality of dewatering blades disposed on a surface of the at least one dewatering box in contact with the first wire loop such that the running of the first wire loop and the second wire loop over the dewatering box is along a curved path.

13. The twin-wire former of claim 8 further comprising a pie-loading blade located inside the second wire loop upstream of the at least one dewatering box.

14. The twin-wire former of claim 8 wherein at the beginning of the at least one dewatering box there is a vacuum-free zone which is opposed by a pro-loading blade located on the side of the second wire loop.

15. A twin-wire former in a paper machine, the former a first forming wire loop;

a second forming wire loop, wherein portions of the first forming wire loop and the second forming wire loop extend adjacent one another to define a twin-wire zone;

at least one dewatering box located inside the first forming wire loop, to remove water through the first forming wire loop from a web being formed, the at least one dewatering box having at least three successive zones arranged in the twin-wire zone, wherein the zones alternate between being a vacuum zone and being a vacuum-free zone; and at least one loading blade, which is located opposite to the at least one dewatering box inside the second wire loop, the at least one loading blade being in contact with the second wire loop at a location opposed by one of the vacuum-free zones, such that the at least one loading blade is positioned such that it is preceded and followed by zones of the at least one dewatering box having vacuum applied thereto.

16. The twin-wire former of claim 15 further comprising a plurality of dewatering blades disposed on a surface of the at least one dewatering box in contact with the first wire loop suck that the running of the first wire loop and the second wire loop over the dewatering box is along a linear path.

17. The twin-wire former of claim 15 further comprising a plurality of dewatering blades disposed on a surface of the at least one dewatering box in contact with the first wire loop such that the running of the first wire loop and the second wire loop over the dewatering box is along a curved path.

18. The twin-wire former of claim 15 further comprising a pre-loading blade located inside the second wire loop upstream of the at least one dewatering box.

19. The twin-wire former of claim 15 wherein at the beginning of the at least one dewatering box there is a vacuum-free zone which is opposed by a pre-loading blade located on the side of the second wire loop.

20. The twin-wire former of claim 15 wherein the at least three successive zones of the at least one dewatering box comprise a first vacuum zone and a second vacuum zone downstream of the first vacuum zone, and wherein the magnitude of the vacuum applied to the first vacuum zone is different than the magnitude of the vacuum applied to the second vacuum zone.

21. The twin-wire former of claim 20 wherein the magnitude of the vacuum applied to first vacuum zone is less than the magnitude of the vacuum applied to the second vacuum zone.

* * * * *

UNITED STATES PATENT AND TRADEMARK OFFICE

CERTIFICATE OF CORRECTION

PATENT NO. : 6,669,820 B2
DATED : December 30, 2003
INVENTOR(S) : Michael Odell

It is certified that error appears in the above-identified patent and that said Letters Patent is hereby corrected as shown below:

Column 4,
Line 51, “forma” should be -- former --
Line 52, “twin-wire” should be -- a twin-wire --
Line 53, “box, which said” should be -- box, said --
Line 58, “include” should be -- includes --
Line 66, “n” should be -- in --

Column 5,
Line 27, “fanning” should be -- forming --
Line 31, “flint” should be -- first --
Line 33, “fanned” should be -- formed --
Line 48, “thin” should be -- than --
Line 52, “fist” should be -- first --

Column 6,
Line 10, “former” should be -- former comprising: --
Line 34, “suck” should be -- such --

Signed and Sealed this

Twenty-third Day of March, 2004

JON W. DUDAS
*Acting Director of the United States Patent and Trademark Office*